US011327440B2

(12) United States Patent
Tombez et al.

(10) Patent No.: US 11,327,440 B2
(45) Date of Patent: May 10, 2022

(54) TIMEPIECE ASSEMBLY COMPRISING A MECHANICAL OSCILLATOR ASSOCIATED WITH AN ELECTRONIC DEVICE FOR CONTROLLING ITS MEAN FREQUENCY

(71) Applicant: The Swatch Group Research and Development Ltd, Marin (CH)

(72) Inventors: Lionel Tombez, Bevaix (CH); Matthias Imboden, St-Blaise (CH)

(73) Assignee: The Swatch Group Research and Development Ltd, Marin (CH)

( * ) Notice: Subject to any disclaimer, the term of this patent is extended or adjusted under 35 U.S.C. 154(b) by 464 days.

(21) Appl. No.: 16/573,022

(22) Filed: Sep. 17, 2019

(65) Prior Publication Data

US 2020/0103827 A1 Apr. 2, 2020

(30) Foreign Application Priority Data

Sep. 27, 2018 (EP) ..... 18197282

(51) Int. Cl.
*G04C 3/04* (2006.01)
*G04B 17/32* (2006.01)
*G04B 17/06* (2006.01)

(52) U.S. Cl.
CPC ..... *G04B 17/32* (2013.01); *G04B 17/063* (2013.01); *G04C 3/042* (2013.01); *G04C 3/047* (2013.01)

(58) Field of Classification Search
CPC ..... G04C 3/042; G04C 3/047; G04C 3/107; G04C 3/04; G04B 17/32
See application file for complete search history.

(56) References Cited

U.S. PATENT DOCUMENTS 7,016,265 B2 * 3/2006 Born ..... G04C 3/066 368/162
7,306,364 B2 * 12/2007 Born ..... G04C 11/084 368/204

(Continued)

FOREIGN PATENT DOCUMENTS

EP 1 014 230 A1 6/2000
EP 1 241 538 A1 9/2002

OTHER PUBLICATIONS

Japanese Office Action dated Sep. 8, 2020 in Japanese Patent Application No. 2019-173713 (with English translation), 6 pages.

(Continued)

*Primary Examiner* — Sean Kayes
(74) *Attorney, Agent, or Firm* — Oblon, McClelland, Maier & Neustadt, L.L.P.

(57) ABSTRACT

A timepiece is provided with a mechanical movement which includes a mechanical resonator, a sensor detecting oscillations of the mechanical resonator, and a braking device arranged to generate braking pulses in response to a control signal provided by a control circuit associated with an auxiliary oscillator. The control circuit is arranged to be capable of detecting a negative or positive temporal drift in the oscillation of the mechanical resonator and to generate, in a correction period, in association with the braking device, when the temporal drift corresponds to at least a certain loss, a series of braking pulses which are applied to the mechanical resonator at a frequency FSUP in a given range of values which is preferably higher than a frequency FZ (N)=2·F0c/N, F0c being a set point frequency for the mechanical resonator and N a positive integer number.

19 Claims, 8 Drawing Sheets

(56) References Cited

U.S. PATENT DOCUMENTS

| | | | | |
|---|---|---|---|---|
| 2002/0141528 | A1 | 10/2002 | Koike et al. | |
| 2004/0013047 | A1 | 1/2004 | Shimizu et al. | |
| 2005/0036405 | A1* | 2/2005 | Born | G04B 17/063 368/127 |
| 2005/0073913 | A1* | 4/2005 | Born | G04C 3/066 368/127 |

OTHER PUBLICATIONS

European Search Report dated Apr. 5, 2019 in European Application 18197282.9, filed Sep. 27, 2018 (with English Translation of Categories of Cited Documents).

* cited by examiner

TIMEPIECE ASSEMBLY COMPRISING A MECHANICAL OSCILLATOR ASSOCIATED WITH AN ELECTRONIC DEVICE FOR CONTROLLING ITS MEAN FREQUENCY

CROSS-REFERENCE TO RELATED APPLICATION

This application claims priority to European Patent Application No. 18197282.9 filed on Sep. 27, 2018, the entire disclosure of which is hereby incorporated herein by reference.

FIELD OF THE INVENTION

The present invention concerns a timepiece comprising a mechanical oscillator whose mean frequency is synchronized at a set point frequency determined by an auxiliary electronic oscillator. To this end, the timepiece includes a control device capable of correcting a possible temporal drift in the operation of the mechanical oscillator, which paces the operation of the timepiece movement in which it is incorporated.

More particularly, the timepiece is provided with a mechanical movement which includes:

- a mechanism for indicating at least one time data item,
- a mechanical resonator capable of oscillating around a neutral position corresponding to its state of minimum potential energy, and
- a device for maintaining the oscillation of the mechanical resonator forming, with said mechanical resonator, a mechanical oscillator which is arranged to pace the running of the indicator mechanism.

This timepiece is also provided with a control device arranged to control the mean frequency of the mechanical oscillator and including:

- a sensor for detecting a number of periods or vibrations in the oscillation of the mechanical resonator in a useful operating range of the mechanical oscillator,
- an auxiliary oscillator,
- a braking device which is arranged to be capable of momentarily applying a braking force to the mechanical resonator, and
- a control circuit including a measuring device arranged to be capable of measuring, on the basis of a detection signal provided by the sensor, a temporal drift of the mechanical oscillator relative to the auxiliary oscillator, this control circuit being arranged to determine whether the measured temporal drift corresponds to at least a certain gain or to at least a certain loss and if so, to be capable of generating a control signal which selectively activates the braking device as a function of the measured temporal drift in order to generate at least one braking pulse which is applied to the mechanical resonator to at least partially correct this temporal drift.

BACKGROUND OF THE INVENTION

Timepieces of the aforementioned type in the field of the invention were recently disclosed in Pat. Nos. CH 713, 306A2 and EP3339982A1.

The timepiece disclosed in Pat. No. CH713,306A2 includes a mechanical movement, provided with a mechanical oscillator, and an electromagnetic system formed of at least one magnet mounted on the balance of a mechanical oscillator and a coil carried by a balance support. The electromagnetic system forms part of a control device arranged to control the mean frequency of the mechanical oscillator both when the oscillator has a positive temporal drift relative to an auxiliary oscillator, for example a quartz oscillator, and when it has a negative temporal drift. After observing that a braking pulse, applied to the resonator forming the mechanical oscillator in one vibration of its oscillation, produces a negative phase shift when it occurs prior to passage of the resonator through its neutral position and a positive phase shift when it occurs after the passage of the resonator through its neutral position, this document proposes a solution wherein the temporal drift is measured and the oscillating motion of the resonator is observed so that the control device can selectively apply thereto one or more braking pulses, respectively via one or more coil short-circuits, in one or more first respective half-vibrations (prior to the passage of the resonator through its neutral position) when the measured temporal drift corresponds to at least a certain gain and in one or more second respective half-vibrations (after the passage of the resonator through its neutral position) when the temporal drift corresponds to at least a certain loss. To achieve this, the electronic circuit of the control device includes a time counter or timer making it possible to determine, by detecting induced voltage pulses in the coil, whether an induced voltage pulse occurs in a first half-vibration or in a second half-vibration in order to selectively apply the braking pulses as indicated above. The control method implemented in this document, although remarkable, requires a relatively complex electronic circuit which thus uses a certain amount of electrical energy which is taken from the mechanical oscillator, which tends to reduce its oscillation amplitude and therefore the normal operating time for a given amount of mechanical energy stored in a barrel of the mechanical movement.

The timepiece disclosed in EP Patent Application No. 3339982A1 is characterized in that the system is arranged to generate mechanical braking pulses applied to the balance of the mechanical oscillator. However, the control method is similar to that of the preceding document. There is provided a sensor arranged to detect the passage of the resonator through its neutral position. On the basis of knowing the set point period of the mechanical oscillator and detections performed by the sensor, a control logic circuit determines via a time counter the instants at which the braking pulses must be triggered so that they occur selectively prior to or after the passage of the mechanical resonator through its neutral position in corresponding vibrations, i.e. to apply mechanical braking pulses either in first half-vibrations or two second half-vibrations. In this case too, a relatively complex electronic circuit is required.

SUMMARY OF THE INVENTION

It is a main object of the present invention to simplify the electronic circuit of the device for controlling the mean frequency of a mechanical oscillator, by providing an alternative to the prior art control devices described in the background of the invention, which is easy to implement in a timepiece.

To this end the invention concerns a timepiece as defined above in the field of the invention and which is characterized in that the control circuit includes a device for generating at least one frequency which is arranged to be capable of generating a periodic digital signal at a frequency $F_{SUP}$; and in that, when it determines a temporal drift corresponding to at least a certain loss in the operation of the timepiece, the control circuit is arranged to be capable of momentarily providing to the braking device a first control signal to activate, during a first correction period, this braking device such that the braking device generates a series of periodic braking pulses which are applied to the mechanical resonator at frequency $F_{SUP}$. The frequency $F_{SUP}$ and the duration of the first correction period are provided and the braking device is arranged so that the series of periodic braking pulses at frequency $F_{SUP}$ is capable to generate, during the first correction period, a synchronous phase in which the mechanical oscillator is synchronized to a correction frequency which is greater than a set point frequency F0c provided for the mechanical oscillator.

In a principal embodiment, the frequency $F_{SUP}$ is comprised in a first range of values extending from (M+1)/M to (M+2)/M inclusive, multiplied by a frequency $F_Z(N)$ which is equal to twice a set point frequency F0c, for the mechanical oscillator, divided by a positive integer number N, that is to say $F_Z(N)=2\cdot F0c/N$ and $[(M+1)/M]\cdot F_Z(N)<F_{SUP}=<[(M+2)/M]\cdot F_Z(N)$, M being equal to one hundred times two to the power of K where K is equal to a positive integer number greater than zero and less than thirteen, that is to say $0<K<13$ and $M=100\cdot 2^K$, and N being less than M divided by thirty, that is to say N<M/30.

In the event that the control circuit determines a temporal drift corresponding to at least a certain gain in the operation of the timepiece, two general embodiments are provided. In the first general embodiment, the control circuit is arranged to be capable, after having detected said at least a certain gain, of stopping the mechanical oscillator and then momentarily locking the mechanical resonator in order to at least partially correct said at least a certain detected gain.

In the second general embodiment, the device for generating at least one frequency is a frequency generator device arranged also to be capable of generating a periodic digital signal at a frequency $F_{INF}$. When the control circuit determines a temporal drift corresponding to at least a certain gain in the operation of the timepiece, the control circuit is arranged to be capable of momentarily providing to the braking device a second control signal to activate said braking device such that the braking device generates, during a second correction period, a series of periodic braking pulses which are applied to the mechanical resonator at frequency $F_{INF}$. The frequency $F_{INF}$ and the duration of the second correction period are provided and the braking device is arranged so that the series of periodic braking pulses at frequency $F_{INF}$ is capable to generate, during the second correction period, a synchronous phase in which the mechanical oscillator is synchronized to a correction frequency which is less than the set point frequency F0c.

The frequency $F_{INF}$ is advantageously comprised in a second range of values extending from (M−2)/M to (M−1)/M inclusive multiplied by said frequency $F_Z(N)$, that is to say $[(M-2)/M]\cdot F_Z(N)=<F_{INF}<[(M-1)/M]\cdot F_Z(N)$.

In a main variant of the second general embodiment, each time the measuring circuit determines that the temporal drift corresponds to at least a certain gain or to at least a certain loss, the control circuit is arranged to be capable of momentarily providing to the braking device a control signal which is selectively formed by:

- a first periodic braking device activation signal, which is determined by said periodic digital signal at said frequency $F_{INF}$, when the temporal drift corresponds to said at least a certain gain, in order to generate a first series of periodic braking pulses which are applied to the mechanical resonator at first frequency $F_{INF}$, and
- a second periodic braking device activation signal, which is determined by said periodic digital signal at said frequency $F_{SUP}$, when the temporal drift corresponds to said at least a certain loss, in order to generate a second series of periodic braking pulses which are applied to the mechanical resonator at frequency $F_{SUP}$.

In particular, the duration of the braking pulses is less than a quarter of a set point period T0c, that is to say $T_P<T0c/4$, T0c being by definition the inverse of set point frequency F0c.

In a preferred variant, positive integer number K is greater than two and less than ten, that is to say $2<K<10$, and the number N is less than the number M divided by a hundred (N<M/100).

In a specific variant, the control circuit is arranged such that the control signal is provided to the braking device, each time the control circuit determines that the temporal drift corresponds to said at least a certain gain or to said at least a certain loss, during a correction period in which the frequency of the mechanical oscillator is synchronized respectively at a first correction frequency Fcor1 which is in said second range of values, computed with Fz (N=2)=F0c, or at a second correction frequency Fcor2 which is in said first range of values computed with Fz (N=2)=F0c.

In a preferred variant, the duration of the synchronous phase is arranged to be considerably greater than a maximum duration of a transitory phase that generally occurs at the start of the correction periods prior to the synchronous phase.

BRIEF DESCRIPTION OF THE DRAWINGS

The invention will be described in more detail below with reference to the annexed drawings, given by way of non-limiting example, in which.

DETAILED DESCRIPTION OF THE INVENTION

Figure 1:
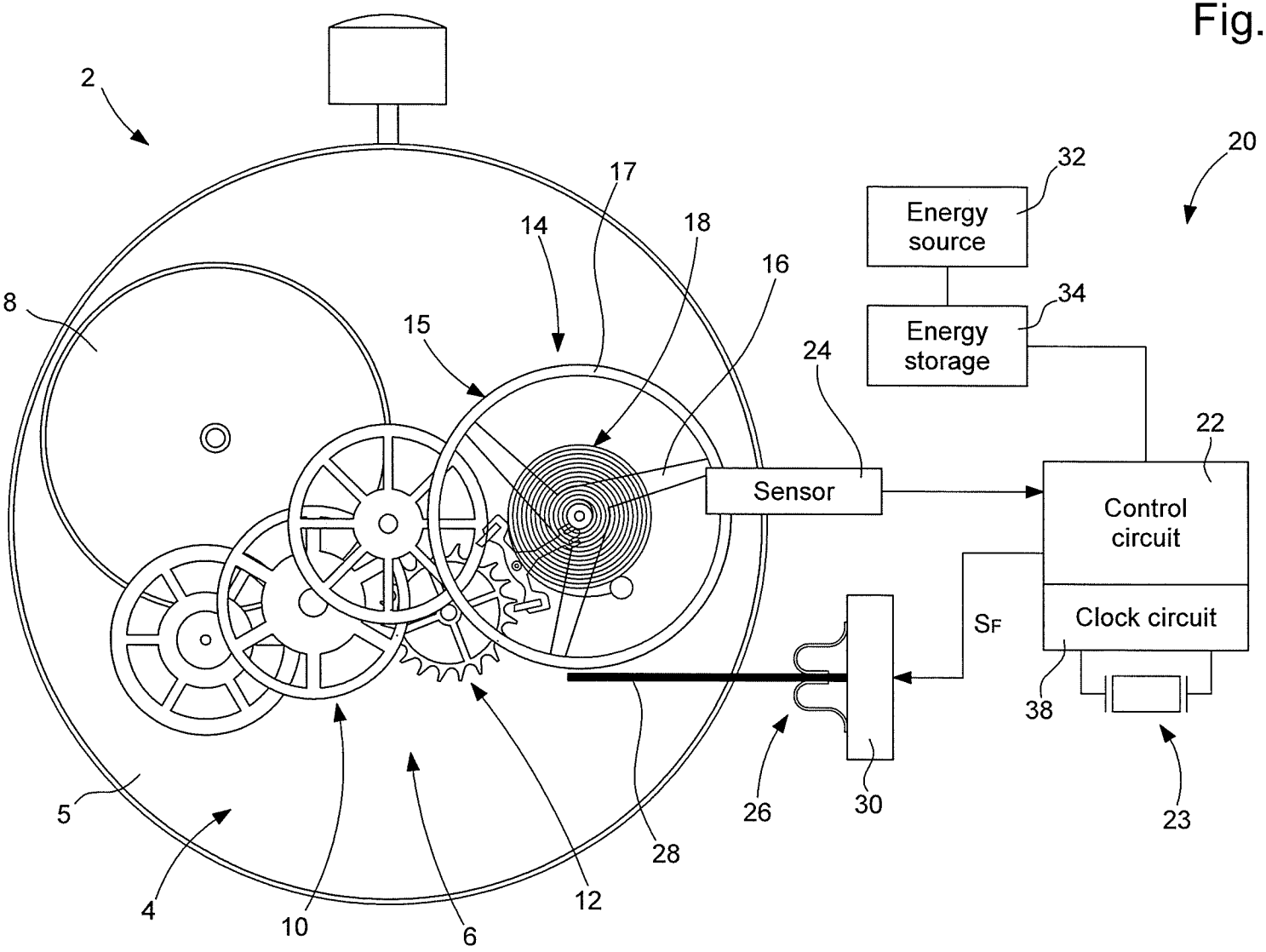
FIG. 1 shows, partly schematically, a first embodiment of a timepiece according to the invention.

FIG. 1 represents a timepiece according to the present invention. Apart from the arrangement of the control circuit and the operating mode of this control circuit, which implements a control method according to the present invention, this timepiece essentially corresponds to the first embodiment of the timepiece disclosed in EP Patent No. 3339982 referring to FIGS. 1 and 2 of that document, so that reference will be made to the teaching of that document and the variants will not all be described here.

Timepiece 2 includes a mechanical timepiece movement 4 which incorporates a mechanism 6 arranged to indicate at least one time data item, a mechanical resonator 14, formed by a balance 16 pivotally mounted on the plate 5 and a balance spring 18, and a device for maintaining the oscillation of the mechanism resonator which, with said mechanical resonator, forms a mechanical oscillator which paces the running of the time data indicator mechanism. The oscillation maintaining device includes an escapement 12 formed by a pallet lever and an escape wheel which is kinematically connected to the barrel 8 via the gear train 10. The mechanical resonator is able to oscillate along an axis of oscillation, which is a circular geometric axis here, around a neutral position corresponding to a state of minimum potential energy. Each oscillation of the mechanical resonator defines one oscillation period and two vibrations.

Timepiece 2 further includes a device for controlling the mean frequency of the mechanical oscillator, this control device 20 including an electronic control circuit 22 which is associated with a reference time base formed by an auxiliary oscillator 26. This auxiliary oscillator is formed by a quartz resonator 23 and a clock circuit 38 which maintains the oscillation of the quartz resonator and receives therefrom a reference frequency signal that the clock circuit outputs in the form of a periodic digital reference signal $S_Q$. It will be noted that other types of auxiliary oscillators can be provided, particularly an oscillator fully integrated in the control circuit. By definition, the auxiliary oscillator is more accurate than the mechanical oscillator. Control device 20 also includes a sensor 24 for detecting at least one angular position of the balance when it is oscillating, making it possible to detect, for a useful operating range of the mechanical oscillator, a number of vibrations or periods in the oscillation of the mechanical resonator. The control device also includes a mechanical braking device 26 arranged to be capable of momentarily applying a braking force to mechanical resonator 14, in particular mechanical braking pulses to its balance. Finally, the timepiece assembly includes an energy source 32 associated with a storage device 34 for the electrical energy produced by the energy source. The energy source is, for example, formed by a photovoltaic cell or by a thermoelectric element, but these examples are non-limiting. In the case of a battery, the energy source and the storage device together form a single same electric component.

Generally, control device 20 also includes a measuring device arranged to measure, on the basis of position signals provided by the sensor, a temporal drift $D_T$ of the mechanical oscillator relative to the auxiliary oscillator (reference time base 36). It is clear that this measurement is easy, given that there is provided a sensor capable of detecting the passage of the mechanical resonator through a certain angular position, particularly through its neutral position. Such an event occurs in every vibration (oscillation half-period) of the mechanical oscillator. The measuring circuit will be described in more detail hereinafter.

Sensor 24 is arranged to be capable of detecting the passage of at least one reference point of balance 16 through a certain given angular position relative to a support of said mechanical resonator. In an advantageous variant, the sensor is arranged to detect the passage of the mechanical resonator through its neutral position. It will be noted that, in this variant, the sensor can be associated with the escapement lever to detect the tilting of the lever during oscillation maintenance pulses which are essentially provided when the mechanical resonator passes through its neutral position.

In a particular variant, sensor 24 is an optical sensor, of the photoelectric type, which includes a light source, arranged to be capable of sending a light beam towards the balance, and a light detector, arranged to receive in return a light signal whose intensity periodically varies as a function of the position of the balance. For example, the beam is sent over side surface 15 of balance rim 17, this surface having a limited area of different reflectivity from the two adjacent areas, such that the sensor can detect the passage of this limited area and provide a position signal to the control device when this event occurs. It will be clear that the circular surface that has variable reflection for the light beam can be located elsewhere on the balance. The variation can, in a particular case, be produced by a hole in the reflective surface. The sensor can also detect the passage of a specific part of the balance, for example an arm, the neutral position corresponding for example to the middle of a signal reflected by the arm. It is thus clear that modulation of the light signal makes it possible to detect in various ways at least one angular position of the balance, by a negative or positive variation in the light captured. In other variants, the position sensor may be of the capacitive or inductive type and thus be arranged to be capable of detecting a variation in capacitance, respectively inductance, as a function of the position of the balance. The sensor includes means for converting the analogue light signal into a digital signal $S_C$. It may also include a flip-flop for dividing by two the light signal when the latter occurs once per vibration, so that signal $S_C$ corresponds to the oscillation frequency F0 of the mechanical oscillator. Those skilled in the art know of many sensors which could easily be incorporated in the timepiece assembly according to the invention.

Mechanical braking device 26 is arranged to be capable of applying to balance 16 mechanical braking pulses in order to control the frequency of the mechanical oscillator when a certain temporal drift $D_T$ is observed in this mechanical oscillator. In an advantageous variant, a braking torque applied to the mechanical resonator by any mechanical braking pulse is less than a locking torque of the mechanical oscillator and the braking pulse duration is arranged to take at most a certain energy from the mechanical resonator, so that the oscillation amplitude remains higher than a given minimum value. In other words, the braking torque is less than the torque exerted by the balance spring at the minimum amplitude provided and the pulse duration is such that this minimum amplitude is respected for a predefined minimum torque force which is exerted by the barrel (note that the mechanical oscillator is maintained by the barrel via the escapement), in order not to momentarily lock the oscillating motion of the mechanical resonator during the braking pulses and to keep the mechanical oscillator within its useful operating range as soon as the barrel exerts a torque force higher than the minimum torque force. In another more general variant, it is possible to apply a braking torque greater than the torque exerted by the balance spring at the minimum amplitude provided, but the pulse duration is determined while considering maintenance of oscillation of the mechanical oscillator, such that this minimum amplitude is maintained for the minimum torque force of the barrel, from which the timepiece is intended to be functional, and for any angular position of the mechanical resonator during application of a braking pulse. It will be noted that the energy taken from the mechanical resonator is maximum when the braking pulse occurs during the passage of the resonator through its neutral position.

In FIG. 1, the mechanical braking device is formed by an actuator 26 which includes a mechanical braking member 28 arranged to be actuated, in response to a control signal $S_F$ provided by the control circuit to the actuator control circuit 30, in order to exert, during the braking pulses, a mechanical braking torque on a braking surface 15 of the pivoting balance 16. In the variant represented, the braking surface is circular and defined by the external side surface of balance rim 17. The mechanical braking member 28 includes a movable portion (formed by the free end of the member) which forms a brake pad arranged to be capable of exerting a certain pressure against the circular braking surface during application of braking pulses to the mechanical resonator.

Actuator 26 includes a piezoelectric element powered by control circuit 30 which applies thereto an electrical activation voltage as a function of control signal $S_F$ supplied by control circuit 22. When the piezoelectric element is momentarily subjected to voltage, the braking member moves into contact with a braking surface of the balance in order to brake it. In the example represented in FIG. 1, the strip forming the braking member bends and its end portion then presses against circular side surface 15 of rim 17 of balance 16. The end portion of the strip thus forms a movable brake pad. In a preferred variant, the pivoting balance and the mechanical braking member are arranged such that the braking pulses can be applied mainly by dynamic dry friction between the mechanical braking member and braking surface 15. In another variant, viscous friction can be provided between the braking member and a braking portion of the balance.

In a particular variant (not represented), the balance includes a central staff which forms or which carries a part other than the balance rim forming a circular braking surface. In such case, a pad of the braking member is arranged to come and exert pressure against this circular braking surface during the application of mechanical braking pulses.

A circular braking surface, for an oscillating member that is pivoted (balance), associated with at least one brake pad, carried by the braking device of the control device, forms a mechanical braking system which has decisive advantages. Indeed, as a result of this system, braking pulses can be applied to the mechanical resonator at any time during oscillations, independently of the oscillation amplitude of the balance. It will also be noted that the pad of the braking member can also have a circular contact surface, of the same radius as the braking surface, but a flat surface has the advantage of leaving some margin in the positioning of the braking member relative to the balance, which allows for greater manufacturing tolerances and tolerances for assembling the braking device inside the timepiece movement or at its periphery.

Advantageously, the various elements of control device 20 form an independent module of the timepiece movement. Thus, this module can be assembled or associated with mechanical movement 4 simply when they are placed inside a watch case. In particular, such a module can be fixed to a casing ring which surrounds the timepiece movement. It is understood that the electronic control unit can thus advantageously be associated with the timepiece movement once the latter has been fully assembled and timed, since the assembly and disassembly of this module can occur without having to act on the actual mechanical movement.

Generally, control circuit 22 is arranged to be capable of determining whether a temporal drift, which is measured by the measuring device on the basis of signals that it receives from sensor 24 and from reference time base 36, corresponds to at least a certain gain or at least to a certain loss and if so, to be capable of generating a control signal which selectively actuates the braking device, to generate periodic braking pulses which are applied to the mechanical resonator with a braking frequency that is a function of the measured temporal drift, in order to at least partially correct this temporal drift.

In a main variant, control circuit 22 includes a frequency generator device arranged to be capable of generating a first periodic digital signal $S_{FI}$ at a first frequency $F_{INF}$ (first braking frequency) and a second periodic digital signal $S_{FS}$ at a second frequency $F_{SUP}$ (second braking frequency).

The first frequency $F_{INF}$ is comprised in a range of values extending from (M−2)/M to (M−1)/M inclusive multiplied by a frequency $F_Z(N)$ which is equal to twice a set point frequency F0c, for the mechanical oscillator, divided by a positive integer number N, that is to say $F_Z(N)=2\cdot F0c/N$ and $[(M-2)/M]\cdot F_Z\ (N)=<F_{INF}<[(M-1)/M]\cdot F_Z\ (N)$, M being equal to one hundred times two to the power of K where K is equal to a positive integer number greater than zero and less than thirteen, that is to say $0<K<13$ and $M=100\cdot 2^K$, and N is less than M divided by thirty, that is to say $N<M/30$. The second frequency $F_{SUP}$ is comprised in a range of values extending from (M+1)/M to (M+2)/M inclusive, multiplied by frequency $F_Z$ (N), that is to say $[(M+1)/M]\cdot F_Z\ (N)<F_{SUP}=<[(M+2)/M]\cdot F_Z\ (N)$, where M and N are defined as above. The operator '=<' means 'equal to or less than', the limit in question being comprised within the range of values.

Control circuit 22 is arranged to momentarily provide, each time that it determines that temporal drift $D_T$ of the mechanical oscillator corresponds to at least a certain gain or at least a certain loss, to braking device 26 a control signal $S_F$ during a correction period, this control signal $S_F$ being selectively formed by:

- the first periodic digital signal $S_{FI}$ when the temporal drift corresponds to at least the certain gain, in order to generate a first series of braking pulses 60 which are applied to mechanical resonator 14 with a first trigger frequency $F1_D$ equal to first frequency $F_{INF}$ (first braking frequency), and
- the second periodic digital signal $S_{FS}$ when the temporal drift corresponds to at least the certain loss, in order to generate a second series of braking pulses 61 which are applied to the mechanical resonator with a second trigger frequency $F2_D$ equal to second frequency $F_{SUP}$ (second braking frequency).

In a preferred variant, positive integer number K is greater than two and less than ten, that is to say 2<K<10, and the number N is less than the number M divided by a hundred (N<M/100).

The duration $T_P$ of the braking pulses is less than half a set point period T0c, that is to say $T_P$<T0c/2, T0c being by definition the inverse of set point frequency F0c for the mechanical oscillator formed of resonator 14 and escapement 12. Preferably, in this first embodiment, the braking pulses have a duration $T_P$ which is less than a quarter of the set point period T0c, that is to say $T_P$<T0c/4.

Figure 2:
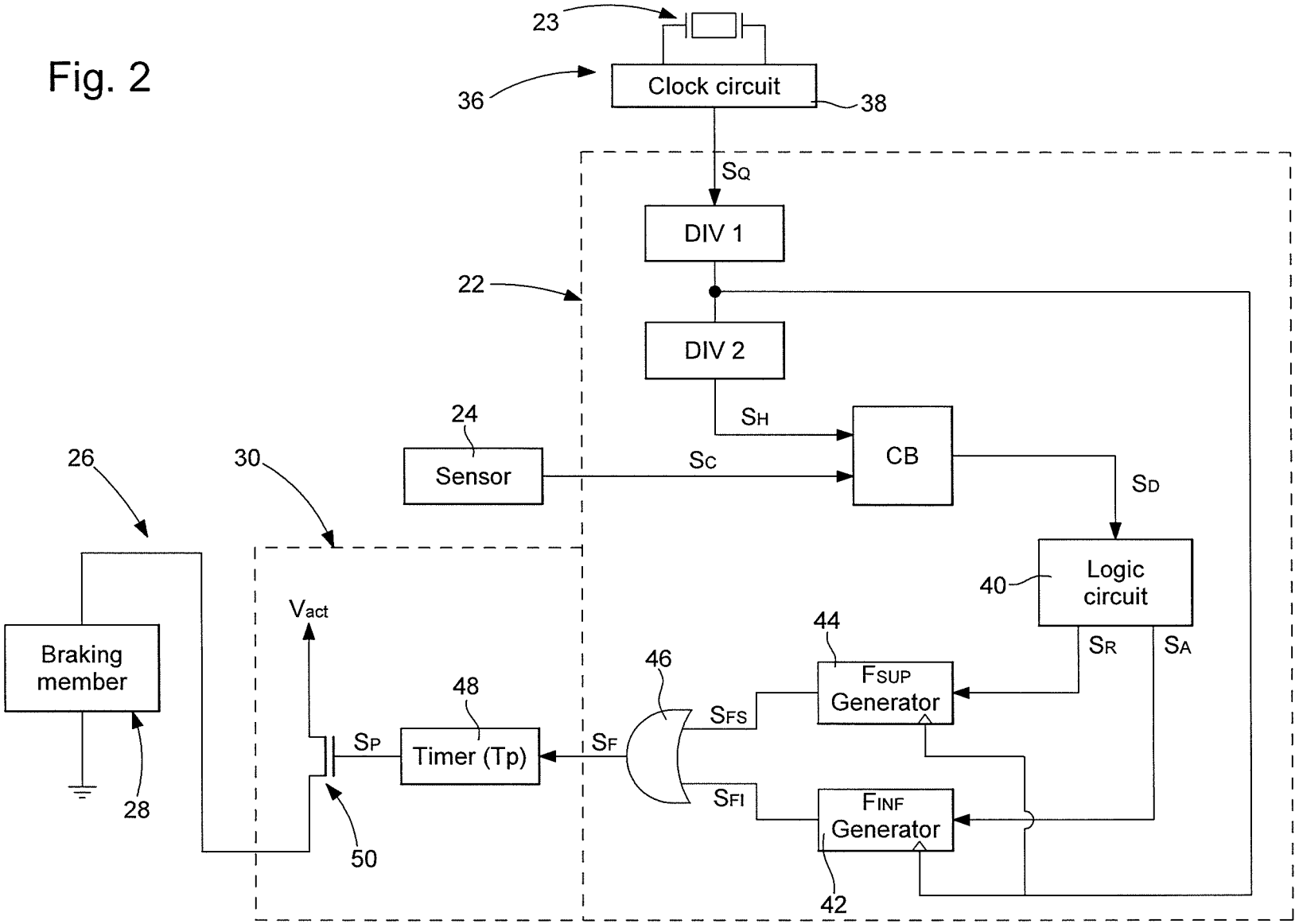
FIG. 2 shows the electronic circuit diagram of a variant of the control device of the first embodiment.
Figure 3:
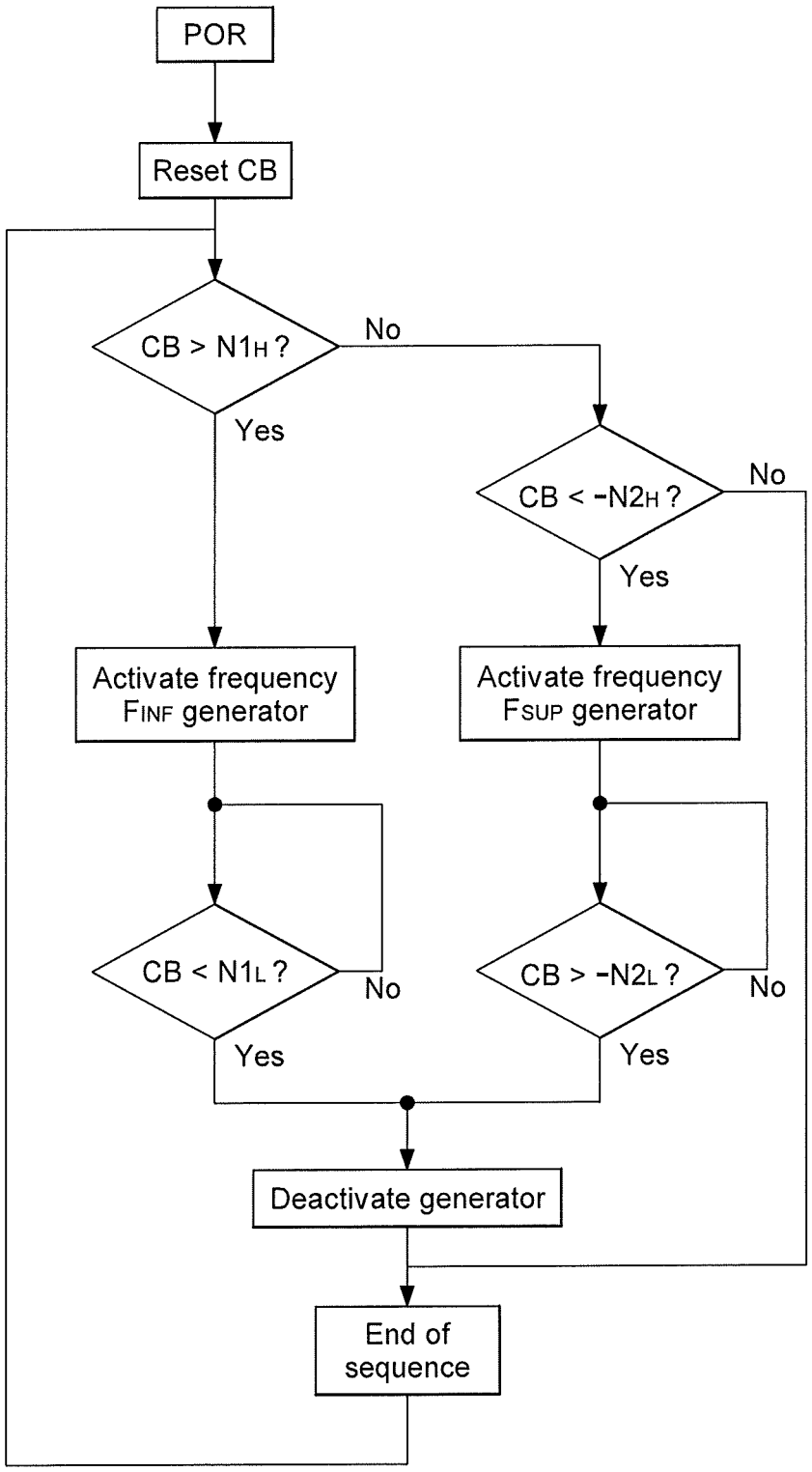
FIG. 3 is a flow chart of an operating mode of the control device of FIG. 2, implemented in its control logic circuit.
Figure 4:
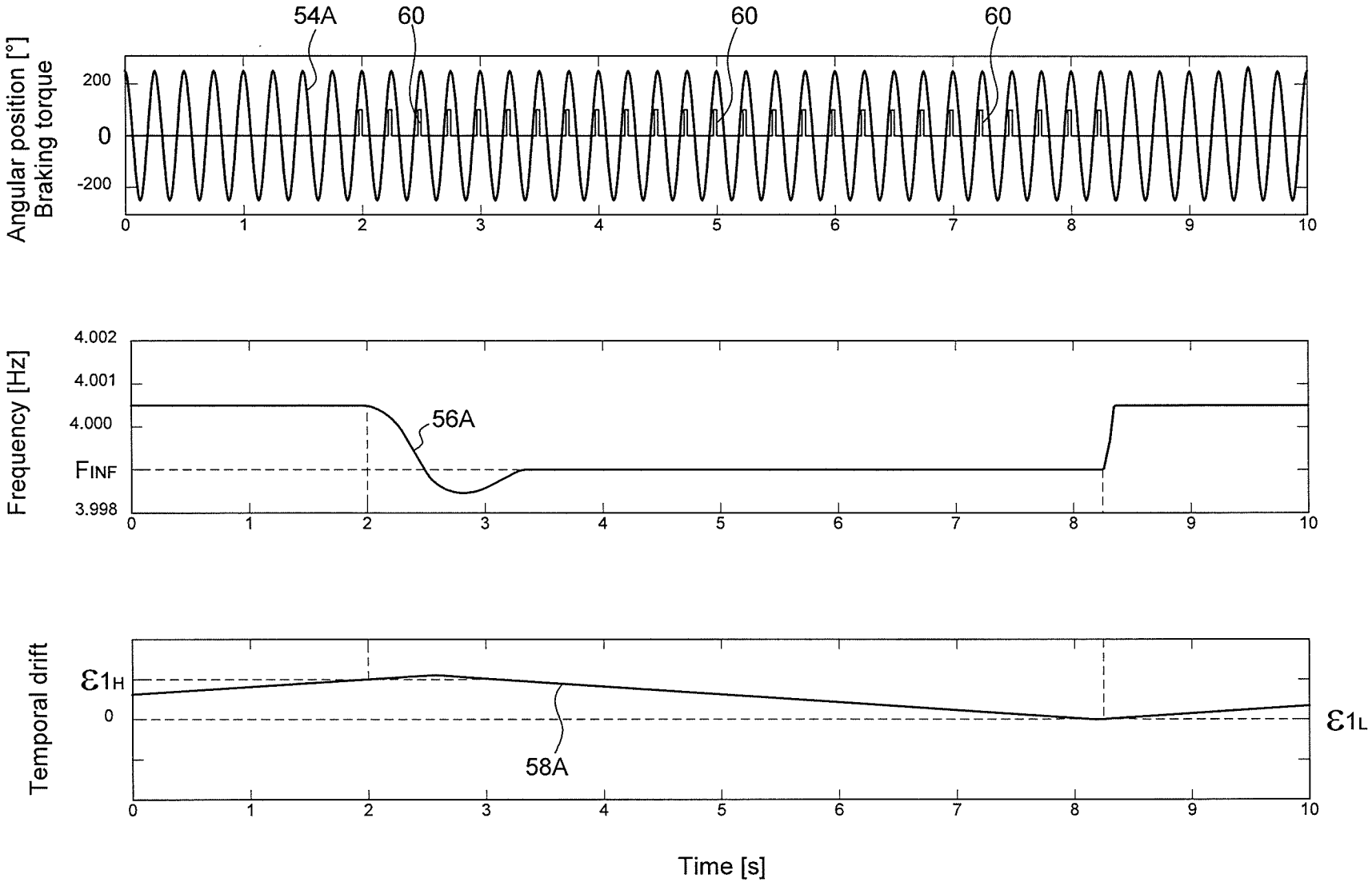
FIG. 4 provides, for a first control mode according to the invention implemented in the first embodiment of the invention and in the case of a timepiece wherein the time data indicator mechanism shows a gain, graphs representing the time evolution of the angular position of the mechanical resonator, a first series of braking pulses applied to the mechanical resonator, in a correction period, as a function of a temporal drift which is also represented, and a graph of the evolution of the instantaneous frequency of the mechanical oscillator in a time interval encompassing the correction period considered.
Figure 5:
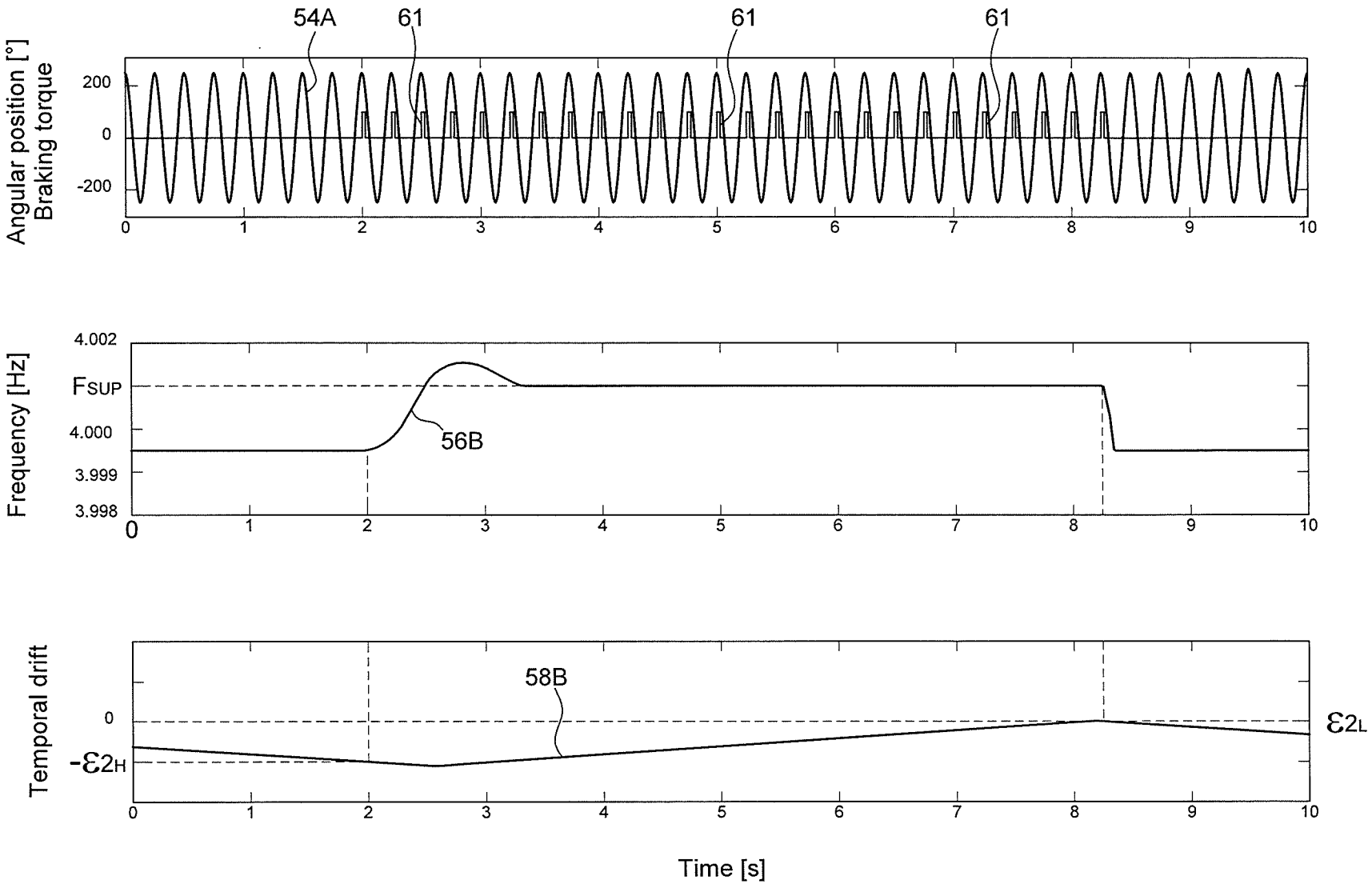
FIG. 5 provides, for the first control mode and in the case of a timepiece wherein the time data indicator mechanism shows a loss, graphs representing the time evolution of the angular position of the mechanical resonator, a second series of braking pulses applied to the mechanical resonator, in a correction period, as a function of a temporal drift which is also represented, and a graph of the evolution of the instantaneous frequency of the mechanical oscillator in a time interval encompassing the correction period considered.

FIG. 2 represents in detail control circuit 22 and the control circuit 30 of actuator 26 forming the mechanical braking device characterizing the first embodiment. The control circuit includes:

- two stages DIV1 and DIV2 of a frequency divider which inputs from reference time base 36 the periodic digital reference signal $S_Q$ and which outputs a clock signal $S_H$ at a lower frequency.
- a bidirectional differential counter CB which receives at one input the clock signal $S_H$ and at a second input the digital signal $S_C$ from sensor 24, which, via this digital signal $S_C$, provides a digital pulse at each vibration or at each oscillation period of mechanical resonator 14, and which outputs a measurement signal $S_D$ corresponding to a value representative of temporal drift $D_T$ of the oscillator,
- a control logic circuit 40 which inputs only measurement signal $S_D$ (apart from a clocking signal generally at a much higher frequency than that of the quartz oscillator, namely much higher than the frequency of reference signal $S_Q$) and which selectively outputs, as a function of the value of measurement signal $S_D$, a control signal $S_R$ and a control signal $S_A$ (which will be described below in the description of a first control mode according to the invention with reference to FIGS. 3 to 5)
- a first frequency generator 42 momentarily providing, when activated by control signal $S_A$, the first periodic digital signal $S_{FI}$, and a second frequency generator 44 momentarily providing, when activated by control signal $S_R$, he second periodic digital signal $S_{FS}$, the first and second frequency generators together forming the aforementioned frequency generator device, and
- and OR logic gate which is connected at input to the respective outputs of the two frequency generators 42 and 44 and which outputs control signal $S_F$.

If the digital signal $S_C$ provided by sensor 24 has a period corresponding to a vibration of the mechanical oscillator, a flip-flop can be arranged in control circuit 22 upstream of counter CB in order to divide by two the periodic pulses of signal $S_C$ and to provide to the input of counter CB a single pulse per oscillation period T0.

Braking device control circuit 30 includes a supply voltage source $V_{ACT}$ which powers the braking member to activate it via a switch 50, which is controlled by periodic signal $S_P$ provided by a timer 48 incorporated in the control circuit to control the braking pulse duration. The timer selectively receives, via control signal $S_F$, the first periodic digital signal $S_{FI}$ and the second periodic digital signal $S_{FS}$ which periodically activate the timer during a correction period as a function of detection of a certain gain or a certain loss in the operation of the mechanical oscillator and therefore in the operation of the timepiece, and this is repeated throughout successive distinct correction periods when a temporal drift persists. Thus, timer 48 periodically makes switch 50 conductive during each correction period to generate, as appropriate, either a first series of braking pulses 60, or a second series of braking pulses 61 (see FIGS. 4 and 5).

In a preferred variant, the braking surface of balance 16 is configured to allow the braking device to start, in a useful operating range of the mechanical oscillator, a braking pulse of each first series of braking pulses and a braking pulse of each second series of braking pulses in any angular position of mechanical resonator 14 between the two extreme angular positions that it can occupy when it oscillates in the useful operating range of the timepiece. Since the amplitude of oscillation of the balance/balance spring is generally greater than 180° (+/−180° in a conventional mechanical movement, the aforementioned condition means, in the variant represented in FIG. 1, that side surface 15 of the balance is circular and substantially continuous over the entire periphery of the balance, such that movable braking member 28 can come to bear against the circular lateral surface 15 at substantially any point.

FIG. 3 shows the flow chart of a first control mode implemented in control circuit 22 of the first embodiment. After activation of the circuit when it is first powered on or in the context of initialisation during such activation, counter CB is reset to zero and it starts to count any difference between the first number of pulses comprised in signal $S_C$ received from sensor 24 and the second number of pulses comprised in clock signal $S_H$. Divider DV1 & DIV2 is arranged such that the clock signal provides a set point signal with a number of pulses per unit of time corresponding to the number of pulses provided in signal $S_C$ per unit of time for proper operation of the timepiece, i.e. without a temporal drift.

In each sequence of the first control mode, logic circuit 40 first determines whether the value of counter CB is greater than a positive integer number $N1_H$ (corresponds to a gain of the mechanical oscillator) or less than a negative integer number−$N2_H$ (corresponding to a loss of the mechanical oscillator). If CB>$N1_H$ (the first case considered), the logic circuit activates frequency generator 42 via a control signal $S_A$ and this frequency generator starts to supply first periodic digital signal $S_{FI}$, at first frequency $F_{INF}$ defined above, to control circuit 30 of the braking device via logic gate 46. As a result, the braking device then starts to periodically generate a first series of braking pulses 60 at first frequency $F_{INF}$. This situation is represented in FIG. 4, which shows:

- in the top graph 54B, the angular position θ of mechanical resonator 14 over a plurality of oscillation periods during which a first series of braking pulses 60 occurs,
- in the intermediate graph 56A, the corresponding evolution of the frequency of the mechanical oscillator (set point frequency $F0_C$ is equal to 4 Hz in the example concerned, namely $F0_C$=4 Hz), and
- in the bottom graph 58A, the corresponding evolution of the temporal drift $D_T$ of the mechanical oscillator.

It will be noted that, in order to provide a visible representation of the angular position of the mechanical resonator and of the braking pulses, FIG. 4 shows only one abbreviated series of braking pulses with a much smaller number of pulses than in reality, such that temporal drift DT corresponds here to a fraction $\varepsilon 1_H$ of the temporal drift $N1_H$. However, this makes it possible to clearly explain the operating principle. In the first case, in the example given, the natural frequency F0=4.0005 Hz, which corresponds to a gain of around ten seconds per day. When the temporal drift reaches or exceeds a value $\varepsilon 1_H$, namely in reality a value $N1_H$, the braking device is actuated via frequency generator 42 and it starts to periodically apply braking pulses 60 to the mechanical resonator at a predefined frequency $F_{INF}$ (for the sake of clarity of the drawing, all the pulses are represented in FIG. 4 as they occur during a stable/synchronous phase explained below). It will be noted that, in the example given, the braking pulses occur in each oscillation period and thus with a frequency F0c, such that the frequency $F_Z$ (N)=2·F0c/N, which is used to define the ranges for the braking frequencies, is given with N=2. For example, as represented in FIG. 4, the first braking frequency $F_{INF}$ is equal to 0.99975.F0c=3.9990 Hz, namely $F_{INF}=F_Z(2)\cdot(L-1)/L=F0c\cdot(L-1)/L$ where L=4,000. This first frequency $F_{INF}$ is in the range $[(M-2)/M]\cdot F_Z(2)$ to $[(M-1)/M]\cdot F_Z(2)$ where K=6, namely $M=100\cdot 2^6$.

During the activation phase of frequency generator 42, logic circuit 40 waits until the value of counter CB becomes equal to or less than an integer number $N1_L$, which is less than number $N1_H$ and preferably less in absolute value than $N1_H$. In the example represented in FIG. 4, $N1_L$ is equal to zero, so that the fraction $\varepsilon 1_L$ of temporal drift $N1_L$ given in FIG. 4 also has a value of zero. As soon as the logic circuit detects the anticipated event, i.e. when the value of counter CB becomes equal to or less than an integer number $N1_L$, the logic circuit ends activation of generator 42, such that the latter is deactivated, which then ends a correction sequence/correction period. If the value $N1_H$=4 and counter CB counts the vibrations of the mechanical oscillator, this corresponds to a temporal drift of half a second. In the example given, the duration $D_{PC}$ of a correction period is at least equal to the aforementioned number L multiplied by the corrected temporal drift, i.e. $D_{PC}=L\cdot D_T$=4,000.0.5=2,000 seconds. Thus, the correction periods each last around 34 minutes, including the initial transitory phase.

In FIG. 4, graph 56A of the frequency of the mechanical oscillator, formed by mechanical resonator 14 and escapement 12, shows the evolution of this frequency resulting from a first control mode sequence in the first case described above. While the frequency of the mechanical oscillator is higher than set point frequency F0c in the absence of braking pulses, this frequency decreases as soon as a first series of braking pulses 60 occurs. A transitory phase is observed before the oscillation frequency stabilises at a first correction frequency Fcor1 which is equal to first frequency $F_{INF}$ where Fz (N=2)=F0c, i.e. Fcor1=$F_{INF}$ (N=2), and thus a synchronous phase appears. Thus, during this synchronous phase, synchronization of the mechanical oscillator is observed at first correction frequency Fcor1 which is slightly lower than the set point frequency, which allows the temporal drift to be corrected, as shown in the bottom graph 58A of FIG. 4. At the end of a first control mode sequence, the temporal drift value is decreased and is equal here to integer number $N1_L$, which corresponds to a lower threshold for the temporal drift, whereas integer number $N1_H$, which triggers a first series of braking pulses, corresponds to an upper threshold of the temporal drift.

It will be noted that, in absolute value, the difference between $F_{INF}$ (N=2) and F0c is preferably greater than a typical difference between F0 and F0c. Thus, the braking device is generally actuated less than half the time, i.e. less than 12 hours per day. In the example given here, assuming that natural frequency F0 remains stable over time, the braking device will have to be actuated for around 8 hours per day.

In each control mode sequence, if CB<$-N2_H$ (the second case considered), logic circuit 40 activates frequency generator 44 via a control signal $S_R$ and this frequency generator starts to supply second periodic digital signal $S_{FS}$, at second frequency $F_{INF}$ defined above, to control circuit 30 of the braking device via logic gate 46. As a result, the braking device then starts to periodically generate a second series of braking pulses 61 at second frequency $F_{SUP}$. This situation is represented in FIG. 5, which shows:

- in the top graph 54B, the angular position of mechanical resonator 14 over a plurality of oscillation periods during which a second series of braking pulses 61 occurs,
- in the intermediate graph 56B, the corresponding evolution of the frequency of the mechanical oscillator, and
- in the bottom graph 58B, the corresponding evolution of the temporal drift $D_T$ of the mechanical oscillator.

It will be noted that, in order to provide a visible representation of the angular position of the mechanical resonator and of the braking pulses, FIG. 5 shows only an abbreviated series of braking pulses with a much smaller number of pulses than in reality, such that temporal drift $D_T$ corresponds here to a fraction$-\varepsilon 2_H$ of the temporal drift$-N1_H$. In the second case, in the example given, the natural frequency F0=3.9995 Hz, which corresponds to a loss of around ten seconds per day. When the temporal drift reaches or becomes less than a value$-\varepsilon 2_H$, namely in reality a value $N2_H$, the braking device is actuated via frequency generator 44 and it starts to periodically apply braking pulses 61 to the mechanical resonator at a predefined frequency $F_{SUP}$ (for the sake of clarity of the drawing, all the pulses are represented in FIG. 5 as they occur during a stable/synchronous phase explained below). In the example represented, as in the first case, frequency $F_Z$ (N)=2·F0c/N is set with N=2, such that frequency $F_Z$ (2)=F0c. The second braking frequency $F_{SUP}$ is equal to 1.00025·F0c=4.001, namely to $F_{SUP}=F0c\cdot(L+1)/L$ where L=4,000. This second frequency $F_{SUP}$ is in the range $[(M+1)/M]\cdot F_Z(2)$ to $[(M+2)/M]\cdot F_Z(2)$ where K=6, namely $M=100\cdot 2^6$. It will be noted that it is not necessary to take the same value for N and the same value for L in the second case (correction of a loss) as in the first case (correction of a gain).

During the activation phase of frequency generator 44, logic circuit 40 waits until the value of counter CB becomes equal to or greater than an integer number $N2_L$, which is greater than number $N2_H$ and preferably less in absolute value than $N2_H$. In the example represented in FIG. 5, $N2_L$ is equal to zero, so that the fraction $\varepsilon 2_L$ of temporal drift $N2_L$ given in FIG. 5 also has a value of zero. As soon as the logic circuit detects the anticipated event, i.e. when the value of counter CB becomes equal to or greater than an integer number $N2_L$, the logic circuit ends activation of generator 44, such that the latter is deactivated, which then ends a correction sequence. The correction sequence is looped, so that logic circuit 40 then returns to the start of the next sequence and it waits for detection of a new temporal drift. Each correction sequence corresponds to a correction period.

In FIG. 5, graph 56B of the mechanical oscillator frequency shows the evolution of this frequency resulting from a first control mode sequence in the second case considered. While, in the absence of braking pulses, the frequency of the mechanical oscillator is less here than set point frequency F0c=4 Hz, this frequency increases as soon as a second series of braking pulses 61 occurs. As in the first case, a transitory phase is observed before the mechanical oscillator frequency stabilises at a second correction frequency Fcor2 equal to second frequency $F_{SUP}$ where Fz (N=2)=F0c, i.e. Fcor2=$F_{SUP}$ (N=2), and thus a synchronous phase appears during the second series of braking pulses 61. Thus, during this synchronous phase, synchronization of the mechanical oscillator is observed at second correction frequency Fcor2 which is slightly higher than set point frequency F0c, which allows temporal drift $D_T$ to be corrected, as shown in the bottom graph 58B of FIG. 5. In this second case, at the end of a first control mode sequence, the absolute temporal drift value is decreased relative to the start of the sequence and is equal here to integer number $N2_L$ which corresponds to a lower threshold for the temporal drift, whereas integer number $N2_H$, which triggers a second series of braking pulses, corresponds to an upper threshold for the temporal drift (note that the notion of lower threshold and upper threshold is considered in absolute values).

The control circuit is arranged such that each correction period has sufficient duration to establish the synchronous phase in which the frequency of the mechanical oscillator is synchronized, as a function of a detected positive or negative drift, respectively at a first correction frequency Fcor1 which is equal to $F_{INF}$ calculated with Fz (N=2)=F0c or at a second correction frequency Fcor2 which is equal to $F_{SUP}$ calculated with Fz (N=2)=F0c.

In a preferred variant, the duration of the synchronous phase is considerably greater than the maximum duration of the transitory phase, notably at least ten times greater.

The timepiece is characterized in that a temporal drift, detected by the control circuit in association with a sensor, is corrected by periodically generating a series of braking series at a selected frequency close to but different from a frequency $F_Z$ (N)=2·F0c/N, N being a positive integer number, which makes it possible to control the mean frequency of the mechanical oscillator so that it is equal to a set point frequency F0c without having to manage the braking pulse trigger times relative to the angular position of the mechanical oscillator as in the prior art. The instant of a first braking pulse of each series of pulses could be determined relative to the angular position of the mechanical oscillator to ensure a relatively short transitory phase prior to the stable synchronization phase, but such a variant is not necessary.

Figure 6:
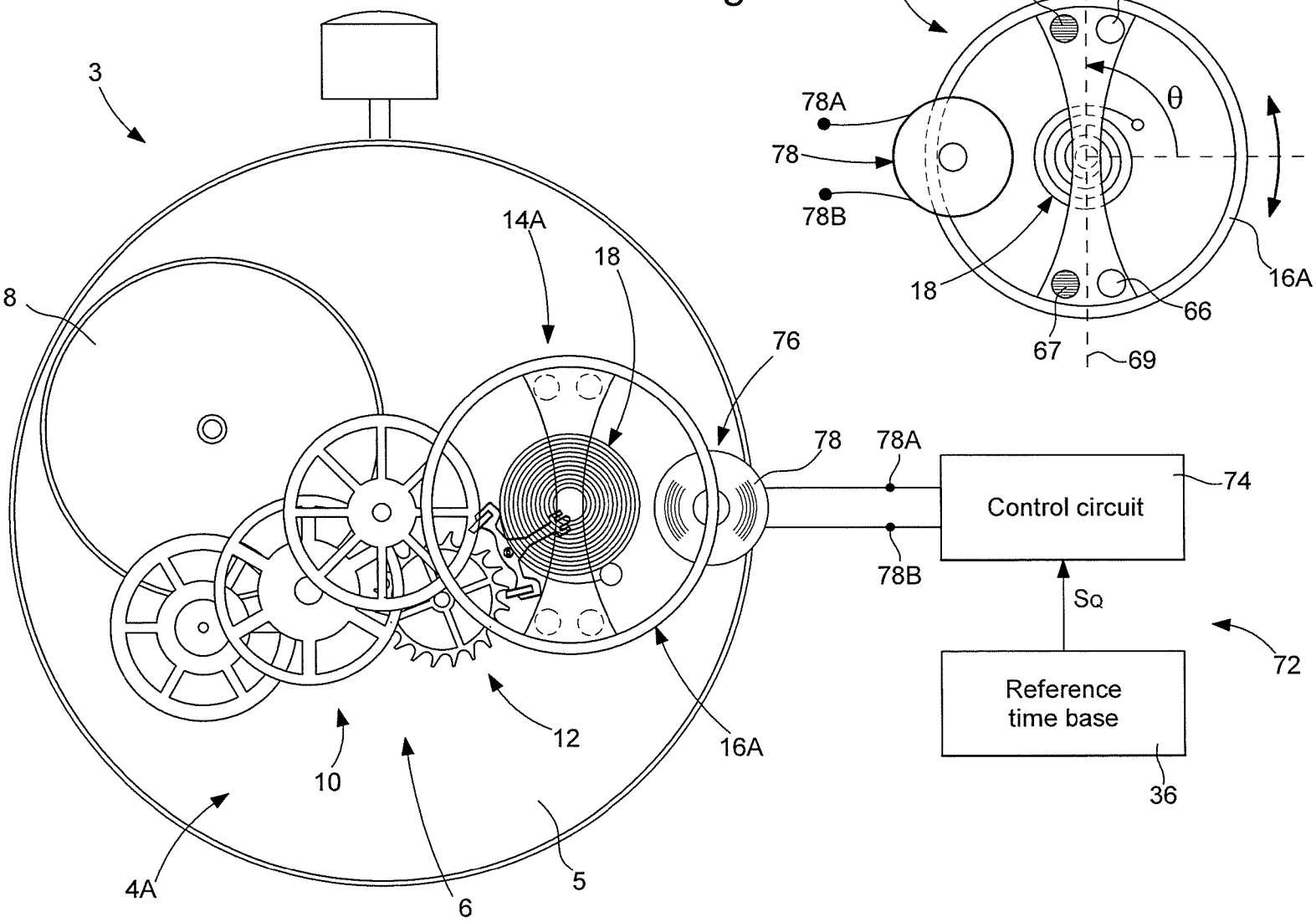
FIG. 6 shows, partly schematically, a second embodiment of a timepiece according to the invention.

Referring to FIGS. 6 to 9, there will be described below a second embodiment of the invention and a second control mode according to the invention. In FIG. 6, the elements of timepiece movement 4A of timepiece 3 that have already been described will not be described again here. Control device 72 of this second embodiment includes:

- a reference time base 36,
- an electromagnetic braking device 76 for braking mechanical resonator 14A during correction periods, and
- a control circuit 74 which receives a periodic digital signal $S_Q$ from the reference time base and which is arranged to generate pulses 84 to short-circuit coil 78 via a switch 50 (see FIGS. 8 and 9) respectively during correction periods for temporal drifts successively detected by this control circuit.

'Electromagnetic braking' means the braking of the mechanical resonator caused by an electromagnetic interaction between at least one permanent magnet, carried by the mechanical resonator or a support of said mechanical resonator, and at least one coil respectively carried by the support or the mechanical resonator and associated with an electronic circuit wherein it is possible to generate an induced current in the coil via the permanent magnet.

In a general variant (not represented), the electromagnetic braking device is formed by an electromagnetic system which includes a coil 78 carried by a support 5 of mechanical resonator 14A and at least one permanent magnet carried by a balance of the mechanical resonator, this electromagnetic system being arranged such that an induced voltage is generated between the two coil terminals 78A & 78B in each vibration during oscillation of the mechanical resonator for a useful operating range of the mechanical oscillator. The control device is arranged to allow the control circuit to momentarily reduce the impedance between the two coil terminals, during distinct time intervals $T_P$, to generate pulses for electromagnetic braking of the mechanical resonator. In the advantageous variant of the second embodiment described with reference to FIGS. 8 and 9, the coil is short-circuited during each distinct time interval $T_P$.

Figure 7:
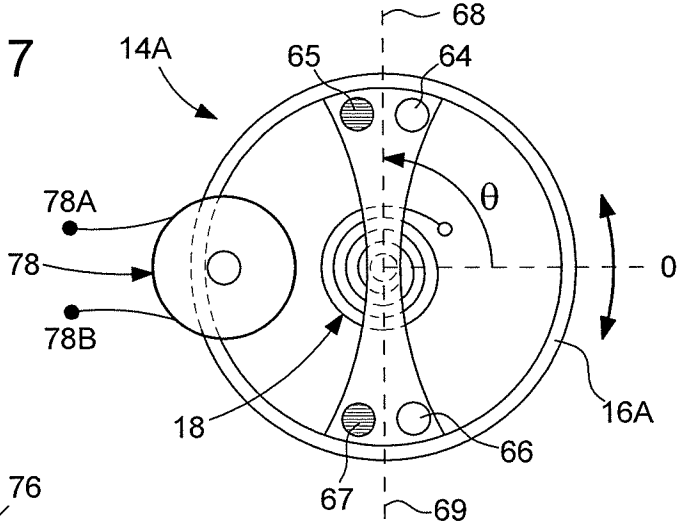
FIG. 7 shows the mechanical resonator and an electromagnetic braking device forming the control device of the second embodiment.

In the particular variant represented in FIGS. 6 and 7, the electromagnetic system of the electromagnetic braking device includes a first pair of bipolar magnets 64 and 65 with axial magnetization and opposite polarity. These two bipolar magnets are arranged on balance 16A symmetrically with respect to a reference half-axis 68 of the balance, this reference half-axis defining a zero angular position ('0') when the mechanical resonator is in its neutral position (state of minimum potential energy). A polar coordinate system centred on the axis of oscillation of mechanical resonator 14A and fixed relative to plate 5 of timepiece movement 3 is considered here. Generally, coil 78 is arranged with an angular offset relative to the zero angular position so that, when the mechanical oscillator oscillates in its useful operating range, a voltage is induced in the coil substantially in every vibration alternately prior to and after the passage of the mechanical resonator through its neutral position in this vibration. The angular offset of the coil is defined as the minimum angular distance between the zero angular position and the angular position of the centre of the coil. In the useful operating range of timepiece 3, the extreme angular positions (amplitudes of oscillation) of the mechanical resonator are set, in absolute values, substantially equal to or greater than the angular offset of the coil. Preferably, as represented in FIG. 7, the angular offset is set substantially equal to 180°. It will be noted that balance 16A is represented in FIG. 7 in an angular position θ equal to 90° (θ=90°.

Figure 9:
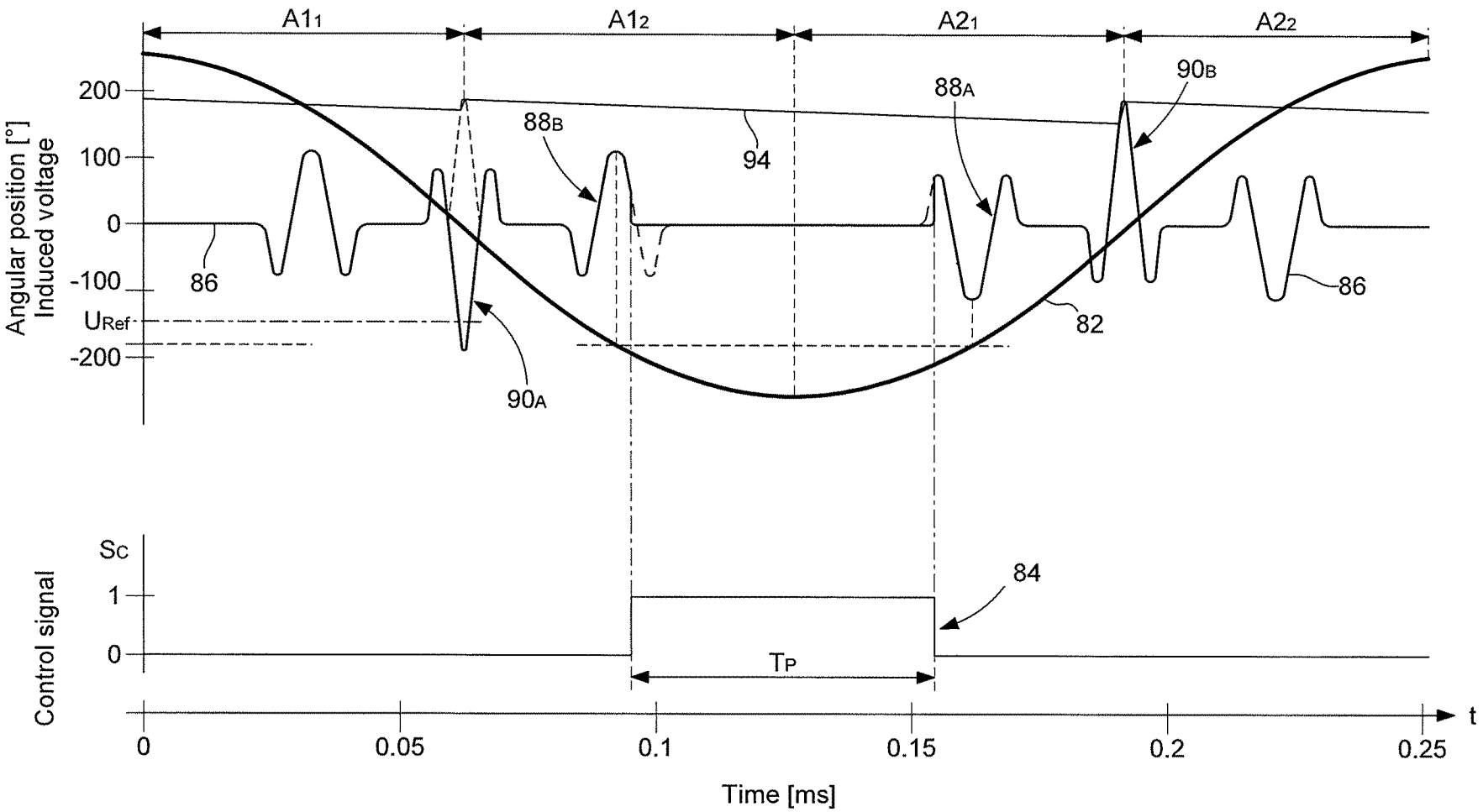
FIG. 9 provides, in the context of the second embodiment, graphs of the angular position of the mechanical oscillator over an oscillation period, of the induced voltage in a coil of the electromagnetic braking device and of a distinct time interval during which a short circuit is applied to the coil, in a stable regime of a synchronization between a frequency generator of the control device and the oscillating mechanical resonator which is obtained during a series of braking pulses applied to the mechanical resonator.

FIG. 9 represents, for an angular offset of 180° and for an amplitude of oscillation of the mechanical resonator in the useful operating range of the oscillator, the angular position of balance 16A (curve 82) over one oscillation period and the induced voltage (curve 86) generated in coil 78 during this oscillation period. In the useful operating range of the mechanical oscillator, the electromagnetic system formed of the coil and the first pair of magnets 64 & 65 generates, in each vibration of the mechanical oscillator, two induced voltage pulses $\mathbf{88}_A$ and $\mathbf{88}_B$, namely one pulse $\mathbf{88}_A$ in each first half-vibration $A\mathbf{1}_1$, $A\mathbf{2}_1$ and one pulse $\mathbf{88}_B$ in each second half-vibration $A\mathbf{1}_2$, $A\mathbf{2}_2$. It is observed that pulses $\mathbf{88}_A$ and $\mathbf{88}_B$ are separated in pairs by time portions with no voltage induced in coil 78. Owing to the position of the coil with an angular offset of 180°, the two induced voltage pulses $\mathbf{88}_A$ and $\mathbf{88}_B$ occurring in each vibration exhibit symmetry relative to the time of passage of mechanical resonator 14A through its neutral position.

Figure 8:
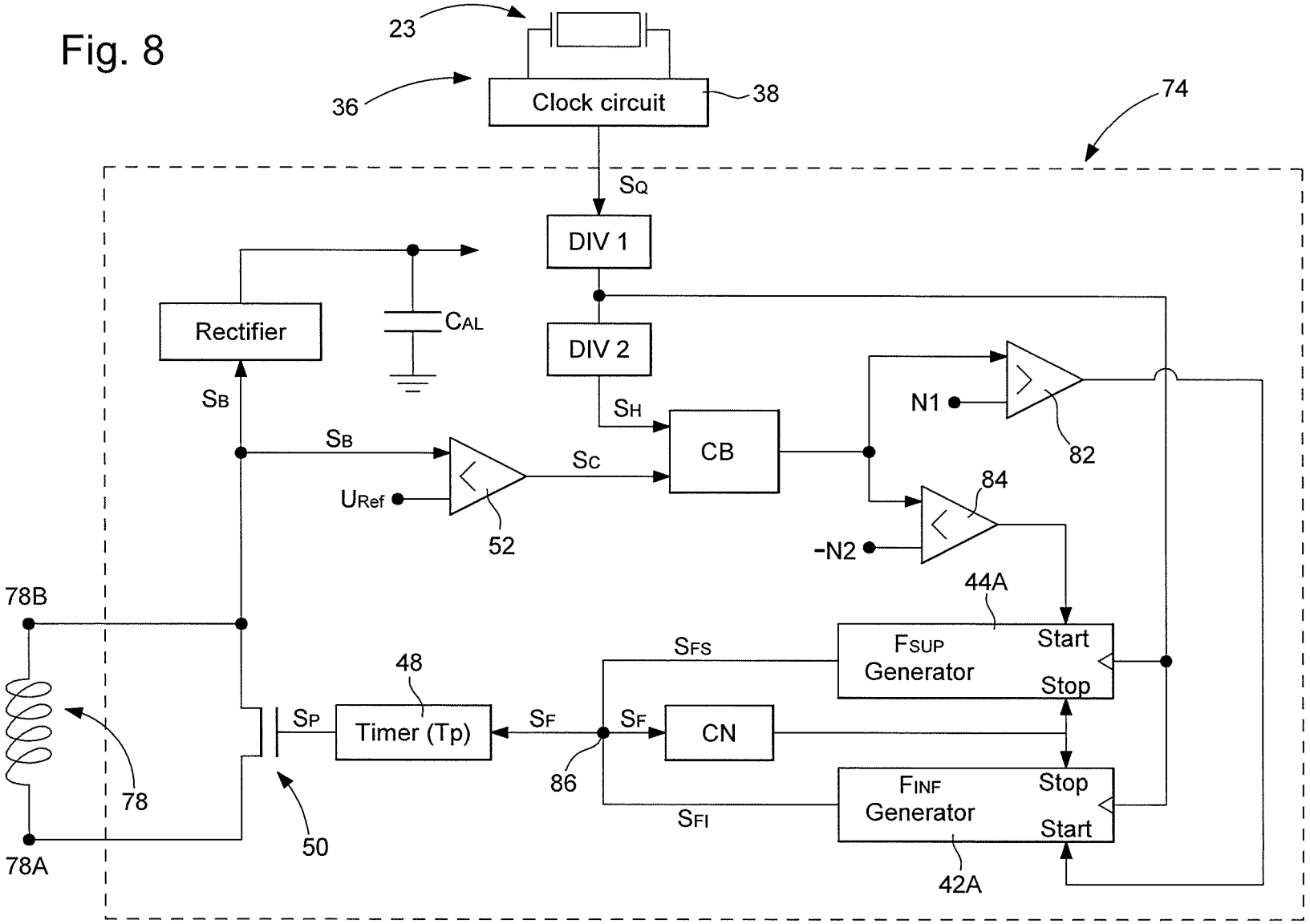
FIG. 8 shows the electronic circuit diagram of a variant of the control device of the second embodiment.

In an advantageous variant represented in FIGS. 8 and 9, electromagnetic braking pulses are generated by a short circuit of coil 78 during distinct time intervals $T_P$ which are substantially equal to or greater than time portions $T_P$ with no voltage induced in the coil around the two extreme positions of the mechanical resonator for the useful operating range of the mechanical oscillator. In the preferred case (angular offset of 180° of the coil), the time portions with no voltage induced in the coil around the two extreme positions of the mechanical resonator are substantially equal.

Preferably, control device 72 includes a power supply circuit formed by a storage capacitor $C_{AL}$ and a rectifier circuit (signal $S_B$) for voltage induced in coil 78 by a second pair of bipolar magnets 66 & 67 carried by balance 16A for this purpose. In FIG. 8, this power supply circuit is represented as part of control circuit 74. However, it can also be considered a specific circuit that is associated with the control circuit to power the latter. The second pair of bipolar magnets 66 & 67 is momentarily coupled to coil 78 in each vibration of the oscillation of the mechanical resonator and is thus essentially used for electrically powering the control device, although it may act in an initial transitory phase of each correction period which will be described below. The second pair of bipolar magnets has a middle half-axis 69 between its two magnets, which is offset by the angular offset of coil 78 relative to reference half-axis 68 so that this half-axis 69 is aligned on the centre of the coil when the mechanical resonator is in its rest position.

The power supply circuit is connected, on the one hand, to a coil terminal, and, on the other hand, to a reference potential (earth) of the control device at least periodically during the passage of the mechanical resonator through its neutral position, but preferably constantly. The second pair of magnets generates induced voltage pulses $\mathbf{90}_A$ and $\mathbf{90}_B$ during passages of balance 8B through the zero angular position; these pulses have greater amplitude than the induced voltage pulses generated by the first pair of magnets 64 & 65 and are used for powering the storage capacitor whose voltage is represented by curve 94 in FIG. 9. The rectifier is a full-wave rectifier here, so that each central peak of pulses $\mathbf{90}_A$ and $\mathbf{90}_B$ recharges the power capacitor.

Control circuit 74 of an advantageous variant of the second embodiment, which implements a second control mode of the invention, is represented in FIG. 8. It inputs, on the one hand, the periodic reference signal $S_Q$ supplied by clock circuit 38 and, on the other hand, an induced voltage signal $S_B$ (curve 86 represented in FIG. 9) supplied by coil 78. On the basis of these two signals, the control circuit regulates the operation of the timepiece as required. To achieve this, it includes a measuring device which includes a divider DIV1 & DIV2 supplying a clock signal $S_H$, bidirectional counter CB with two inputs (of the differential type), and a comparator 52 which inputs a reference voltage $U_{Ref}$ and induced voltage signal $S_B$.

As shown in FIG. 9, it is arranged to detect in each oscillation period, for the useful operating range of the mechanical oscillator, a central negative peak of an induced voltage pulse 90A occurring once in each oscillation period. Comparator 52 indicates if the voltage induced in the coil becomes lower than the reference voltage (which is negative). It is clear that the value of $U_{Ref}$ is selected here to be, in absolute value, greater than the amplitude of the induced voltage pulses $\mathbf{88}_A$ and $\mathbf{88}_B$ which are generated by the first pair of magnets 64 & 65 and less than the amplitude of the central peaks of pulses $\mathbf{90}_A$ (note that, compared to the amplitude of induced voltage pulses $\mathbf{88}_A$ and $\mathbf{88}_B$, the central peaks have a higher maximum value than represented in FIG. 9 in the case of an angular offset of 180° of the coil). Thus, in the second embodiment, the sensor is preferably formed by an electromagnetic system comprising coil 78 and an additional pair of magnets 66 & 67 compared to the magnetic system of the braking device.

By analogy with the first embodiment described above, comparator 52 can also be considered as part of the sensor and not of the measuring device. It will be noted that, generally, an additional pair of magnets is advantageous but not indispensable, since in another variant, pulses $\mathbf{88}_A$ and $\mathbf{88}_B$ can also be used for electrically powering the control device and also for detecting the number of vibrations or oscillation periods of the mechanical resonator. Generally, the reference voltage is selected such that, in a useful operating range of the mechanical oscillator, comparator 52 supplies to a first input of counter CB a predetermined number of pulses per oscillation period of the mechanical resonator, and clock signal $S_H$ is set so that it delivers the same number of pulses per set point period T0c (inverse of set point frequency F0c) to a second input of counter CB. As in the first embodiment, this counter CB outputs a signal corresponding to its state and which gives a measurement of temporal drift $D_T$ of the mechanical oscillator relative to auxiliary oscillator 36.

The state of counter CB is provided to two comparators 82 and 84. The first comparator 82 compares the state of counter CB to a first integer number N1 greater than zero, to determine whether or not the measured temporal drift is greater than this first number N1, and thus detects whether at least a certain gain has occurred in the operation of the mechanical oscillator. The second comparator 84 compares this state to a second negative integer number−N2, N2 being greater than zero, to determine whether or not the measured temporal drift is less than this second number−N2, and thus detects whether at least a certain loss has occurred in the operation of the mechanical oscillator. The output of first comparator 82 is provided to a first frequency generator 42A arranged to generate a first periodic digital signal $S_{FI}$ at first frequency $F_{INF}$ during a correction period each time that this output indicates that the state of counter CB is greater than number N1. More particularly, first generator 42A of frequency $F_{INF}$ includes means arranged for activating and then deactivating said generator, the signal provided by the first comparator being provided to a 'start' input of the first generator to activate it as soon as this first comparator indicates that the state of counter CB is greater than number N1. Similarly, the output of second comparator 84 is provided to a second frequency generator 44A arranged to generate a second periodic digital signal $S_{FS}$ at second frequency $F_{SUP}$ during a correction period each time that this output indicates that the state of counter CB is less than number−N2. More particularly, second generator 44A of frequency $F_{SUP}$ includes means arranged for activating and then deactivating said generator, the signal provided by the second comparator being provided to a 'start' input of the second generator to activate it as soon as the second comparator indicates that the state of counter CB is less than number−N2. The first and second periodic digital signals and frequencies have already been described in the context of the first embodiment and have the same characteristics in the second embodiment as in the first embodiment, so these signals and frequencies will not be described again here. Control signal $S_F$ is similar to that described in the first embodiment; it is formed of signal $S_{FI}$ when the first frequency generator is activated and of signal $S_{FS}$ when the second frequency generator is activated.

It is understood that the two frequency generators are never simultaneously activated. Electrical connection point 86 corresponds in practice to an electronic element, for example an 'OR' logic gate, or to an electronic circuit, for example a multiplexer with two or three input positions and only one output (it is thus a switch with two or three inputs here). In the case of three input positions, there is advantageously a neutral position in which the switch is not connected to either of the two frequency generators. As in the first embodiment, control signal $S_F$ is provided to a timer 48 which outputs the periodic signal $S_P$ described above. For each elementary pulse of signal $S_{FI}$ or of signal $S_{FS}$, corresponding to a period of the respective frequency, the timer generates a pulse to activate switch 50, which is a short circuit switch for coil 78 here. Thus, in each period of signal $S_{FI}$ and of signal $S_{FS}$ a short circuit pulse is generated during a distinct time interval of duration $T_P$.

An N counter (referenced CN) also receives control signal $S_F$ and it counts the number of elementary pulses (number of periods) in this control signal $S_F$ from the start of each correction period. It is thus reset to zero at the start of any correction period, simultaneously with the activation, as appropriate, of the first or second frequency generator. This N counter stops the frequency generator which was activated in the correction period concerned as soon as it has counted N elementary pulses (i.e. N periods) via an input 'Stop' comprised in each of the two frequency generators, N being an integer number greater than one (N>1). In an advantageous variant, the N counter is then deactivated until the start of the next correction period. Preferably, the number N is considerably greater than '1', this number N being, for example, comprised between 100 and 10,000. In each correction period N short circuit pulses are thus generated for coil 78 during N respective distinct time intervals each having a duration $T_P$.

It will be noted that it is possible to know approximately which temporal drift $D_T$ (absolute time error) is corrected by a certain number N of short circuit pulses generated in one correction period, so that it is easy to select a number N which corresponds to the detected temporal $D_T$. In a preferred variant where the two frequency differences between set point frequency F0c and respectively the first frequency $F_{INF}$ and the second frequency $F_{SUP}$ are set at the same value and where the number N1 is equal to the number N2, the number N is chosen so that a negative or positive detected temporal drift is substantially corrected during a correction period that follows the detection thereof. The same result can be obtained with a number N1 different from the number N2 if the two aforementioned frequency differences are not set at the same value.

Generally, on the basis of the teaching given in Pat. No. CH 713306, it is understood that, on the one hand, if short circuit pulses 84 for coil 78 occur at least partially during pulses $\mathbf{88}_A$, these induced voltage pulses $\mathbf{88}_A$ generate distinct electromagnetic braking pulses which produce negative phase shifts in the oscillation of mechanical resonator 14A, so that they can generate a loss in the operation of the timepiece to correct a gain. On the other hand, if short circuit pulses 84 for coil 78 occur at least partially during pulses $\mathbf{88}_B$, these induced voltage pulses $\mathbf{88}_B$ generate distinct electromagnetic braking pulses which produce positive phase shifts in the oscillation of mechanical resonator, so that they can generate a gain in the operation of the timepiece to correct a loss. It will be noted that an angular offset of 180° has the advantage of great efficiency for generating braking pulses via short circuit pulses 84, which efficiently corrects a gain or a loss in the operation of the timepiece.

As in the first embodiment, during a correction period in which there is generated either a first series of braking pulses via a corresponding first series of coil short circuit pulses, or a second series of braking pulses via a corresponding second series of coil short circuit pulses, a transitory phase is observed in a first part of the correction period (of varying length depending on the case and in particular depending on the time at which the first short circuit pulse of the N short circuit pulses generated in each correction period occurs) during which the instantaneous frequency of the mechanical oscillator changes from the frequency that it had prior to the correction period in question to the selected correction frequency, namely either frequency $F_{INF}$ (N=2) or frequency $F_{SUP}$ (N=2) depending on the detected temporal drift that is being corrected. Following the transitory phase there is a stable phase/synchronous phase in a second part of the correction period. During the synchronous phase, the oscillator frequency is synchronized at the selected correction frequency, namely at the first correction frequency Fcor1 or at the second correction frequency Fccor2. It is thus observed that, provided that the natural temporal drift of the timepiece remains in a nominal range for which the electromagnetic braking device has been designed, in each correction period there is a synchronous phase where the mechanical oscillator exhibits the correction frequency selected by selecting braking frequency $F_{INF}$ or $F_{SUP}$, regardless of the angular position of balance 16A during a first short circuit pulse in any correction period. In the synchronous phase, if there is no particular external disturbance (for example a shock or a certain acceleration of the balance due to an abrupt movement), each short circuit pulse generates an electromagnetic braking pulse, which is not always the case in the transitory phase.

In the synchronous phase, it is observed in FIG. 9 that short circuit pulses 84 are positioned between two induced voltage pulses $\mathbf{88}_B$ and $\mathbf{88}_A$ surrounding an extreme angular position of the mechanical resonator and two distinct braking pulses occur respectively at the start and at the end of each time interval $T_P$, these two distinct braking pulses corresponding to two quantities of energy which are taken from the mechanical resonator during a braking pulse corresponding to a short circuit pulse and which are variable (the variation of one being opposite to the variation of the other, such that if one of the two quantities of energy increases or decreases the other respectively decreases or increases) as a function of the frequency deviation between natural frequency F0 of the mechanical oscillator and the selected correction frequency and the selected braking frequency. Two braking pulses are distinct when they are separated by a time portion having a non-zero duration. 'Natural frequency F0' means the frequency that the mechanical oscillator would naturally have during the correction period concerned, that is to say in the hypothetical case of an absence of short circuit pulses.

It will be noted that, in the definition of the present invention in the specification and claims, the braking pulses in the second embodiment respectively correspond to the short circuit pulses that they produce, so that each braking pulse of a first series of braking pulses and of a second series of braking pulses encompasses all the distinct braking pulses that may occur during time interval $T_P$ of the corresponding short circuit pulse. It will also be noted that, in the transitory phase, if time intervals T are less than time portions with no voltage induced in the coil, it is possible for no braking pulses to appear in the initial short circuit pulses. In the synchronous phase of a correction period, a braking pulse may contain only one distinct braking pulse, which is the case when time interval $T_P$ has a duration less than that of the time portions with no induced voltage situated around the extreme angular positions. In the advantageous variant represented in FIG. 9, each braking pulse occurring in the synchronous phase of a correction period has two distinct braking pulses, respectively at the start and at the end of each corresponding short circuit pulse which is generated during a time interval $T_P$.

FIG. 9 corresponds to a situation where the natural oscillation frequency F0 of the mechanical resonator is slightly lower than the set point frequency F0c, such that the timepiece runs slow in the absence of correction. In such case, in each oscillation period during synchronous phases of successive correction periods to correct a certain loss in the operation of the timepiece, a first distinct braking pulse, generated in the initial portion of each short circuit pulse 84 and occurring in the second half-vibration $A1_2$ of a first oscillation vibration A1 (at the start of distinct time intervals $T_P$), is stronger than a second distinct braking pulse generated in the final portion of each short circuit pulse and occurring in the first half-vibration $A2_1$ of a second vibration A2 (at the end of distinct time intervals $T_P$). The first and second distinct braking pulses are respectively generated by the induced voltage pulses $88_B$ and $88_A$ during each short circuit pulse 84 (respectively at the start and at the end of distinct time intervals $T_P$). Thus, in this case, the positive phase shift generated by a voltage pulse $88_B$ in a first half-vibration A1 is greater than the negative phase shift generated by voltage pulse $88_A$ in the next half-vibration $A2_1$, so that a small correction of the detected loss occurs during each short circuit pulse.

In the situation where the timepieces naturally runs fast, the inverse is observed, namely that, in the synchronous phase of the correction period, the aforementioned second distinct braking pulse is stronger than the first distinct braking pulse during each short circuit pulse, such that a small correction of the detected gain occurs during each short circuit pulse.

The invention claimed is:

1. A timepiece provided with a mechanical movement comprising:

a mechanism for indicating at least one time data item, a mechanical resonator capable of oscillating around a neutral position corresponding to its state of minimum potential energy, and a device for maintaining the oscillation of the mechanical resonator forming with said mechanical resonator a mechanical oscillator which is arranged to pace the running of the indicator mechanism;

the timepiece being also provided with a control device arranged to control the mean frequency of the mechanical oscillator and which includes:

a sensor arranged to be capable of detecting a number of periods or vibrations in the oscillation of the mechanical resonator in a useful operating range of the mechanical oscillator, an auxiliary oscillator, a braking device which is arranged to be capable of momentarily applying a braking force to the mechanical resonator, a control circuit including a measuring device arranged to be capable of measuring, on the basis of a detection signal provided by the sensor, a temporal drift of the mechanical oscillator relative to the auxiliary oscillator, this control circuit being arranged to determine whether a measured temporal drift corresponds to at least a certain gain or to at least a certain loss and if so, to be capable of generating a control signal which selectively activates the braking device as a function of the measured temporal drift in order to generate at least one braking pulse which is applied to the mechanical resonator to at least partially correct the measured temporal drift; wherein the control circuit includes a device for generating at least a frequency $F_{sup}$ which is arranged to be capable of generating a periodic digital signal at this frequency $F_{sup}$; and wherein, when the control circuit determines a temporal drift corresponding to at least a certain loss in the operation of the timepiece, the control circuit is arranged to be capable of momentarily providing to the braking device a first control signal to activate said braking device such that the braking device generates, during a first correction period, a series of periodic braking pulses which are applied to the mechanical resonator at said frequency $F_{sup}$; this frequency $F_{sup}$ and the duration of the first correction period being provided and the braking device being arranged so that the series of periodic braking pulses at frequency $F_{sup}$ is capable to generate, in the first correction period, a synchronous phase in which the mechanical oscillator is synchronized to a correction frequency which is greater than a set point frequency F0c provided for the mechanical oscillator.

2. The timepiece according to claim 1, wherein said frequency $F_{sup}$ is comprised in a first range of values extending from (M+1)/M to (M+2)/M inclusive multiplied by a frequency $F_z(N)$ equal to twice the set point frequency F0c divided by a positive integer number N, that is to say $[(M+1)/M]\cdot F_Z(N)<F_{SUP}=<[(M+2)/M]\cdot$ where $F_Z(N)=2\cdot F0c/N$, M being equal to one hundred times two to the power of K where K is equal to a positive integer number greater than zero and less than thirteen, that is to say $0<K<13$ and $M=100\cdot 2^K$, and N being less than M divided by thirty, that is to say $N<M/30$.

3. The timepiece according to claim 2, wherein the positive integer number K is greater than two and less than ten, that is to say $2<K<10$, and the number N is less than the number M divided by a hundred ($N<M/100$).

4. The timepiece according to claim 1, wherein said device for generating at least one frequency is a frequency generator device arranged also to be capable of generating a periodic digital signal at a frequency $F_{INF}$; and wherein, when the control circuit determines a temporal drift corresponding to at least a certain gain in the operation of the timepiece, the control circuit is arranged to be capable of momentarily providing to the braking device a second control signal to activate said braking device such that the braking device generates, during a second correction period, a series of periodic braking pulses which are applied to the mechanical resonator at said frequency $F_{INF}$; said frequency $F_{INF}$ and the duration of the second correction period being provided and the braking device being arranged so that the series of periodic braking pulses at frequency $F_{INF}$ is capable to generate, in the second correction period, a synchronous phase wherein the mechanical oscillator is synchronized to a correction frequency which is less than set point frequency F0c.

5. The timepiece according to claim 4, wherein the mechanical braking pulses have a duration $T_P$ less than a quarter of a set point period T0c, that is to say $T_P<T0c/4$, T0c being by definition the inverse of set point frequency F0c.

6. The timepiece according to claim 4, wherein said frequency $F_{INF}$ is comprised in a second range of values extending from (M−2)/M to (M−1)/M inclusive multiplied by the frequency $F_Z(N)$, that is to say $[(M-2)/M]\cdot F_Z(N)=<F_{INF}<[(M-1)/M]\cdot F_Z(N)$.

7. The timepiece according to claim 6, wherein each time that the measuring circuit determines a temporal drift corresponding to at least a certain gain or to at least a certain loss, the control circuit is arranged to be capable of momentarily providing to the braking device a control signal which is selectively formed by:

a first periodic braking device activation signal, which is determined by said periodic digital signal at said frequency $F_{INF}$, when the temporal drift corresponds to said at least a certain gain, in order to generate a first series of periodic braking pulses which are applied to the mechanical resonator at said frequency $F_{INF}$, and a second periodic braking device activation signal, which is determined by said periodic digital signal at said frequency $F_{SUP}$, when the temporal drift corresponds to said at least a certain loss, in order to generate a second series of periodic braking pulses which are applied to the mechanical resonator at said frequency $F_{SUP}$.

8. The timepiece according to claim 6, wherein the positive integer number K is greater than two and less than ten, that is to say 2<K<10, and the number N is less than the number M divided by a hundred (N<M/100).

9. The timepiece according to claim 1, wherein the braking device is formed by an actuator which includes a mechanical braking member arranged to be actuated, in response to said control signal, in order to exert, during the braking pulses, a mechanical braking torque on a braking surface of a pivoting balance comprised in the mechanical resonator.

10. The timepiece according to claim 9, wherein the pivoting balance includes a rim which forms the braking surface, which is circular; and wherein the mechanical braking member includes a movable portion which forms a brake pad arranged to be capable of exerting a certain pressure against the circular braking surface during the application of braking pulses to the mechanical resonator.

11. The timepiece according to claim 10, wherein the pivoting balance and the mechanical braking member are arranged such that the mechanical braking pulses can be applied mainly by dynamic dry friction between the mechanical braking member and the braking surface.

12. The timepiece according to claim 9, wherein the braking surface is configured to allow the braking device to start, in a useful operating range of the mechanical oscillator, a braking pulse of each first series of braking pulses and a braking pulse of each second series of braking pulses in any angular position of the mechanical resonator along said axis of oscillation.

13. The timepiece according to claim 1, wherein the mechanical braking pulses have a duration $T_P$ less than a quarter of a set point period T0c, that is to say $T_P$<T0c/4, T0c being by definition the inverse of set point frequency F0c.

14. The timepiece according to claim 1, wherein the braking device is formed by an electromagnetic system which comprises a coil carried by the mechanical resonator or a support of said mechanical resonator and at least one permanent magnet respectively carried by said support or said mechanical resonator, the electromagnetic system being arranged such that an induced voltage is generated by said at least one permanent magnet between the two coil terminals in each vibration of oscillation of the mechanical resonator for a useful operating range of the mechanical oscillator; and wherein the control device is arranged to allow the control circuit to periodically decrease the impedance between the two coil terminals during distinct time intervals to generate said series of periodic braking pulses at frequency $F_{INF}$ and said series of braking pulses at frequency $F_{SUP}$.

15. The timepiece according to claim 14, wherein the electromagnetic system comprises a pair of bipolar magnets with axial magnetization and opposite polarity, said two bipolar magnets being symmetrically arranged on a balance with respect to a reference half-axis of said balance, said reference half-axis defining a zero angular position when the mechanical resonator is in its neutral position; and wherein the coil is arranged on said support and has an angular offset relative to the zero angular position such that a voltage induced in said coil occurs substantially, when the mechanical oscillator oscillates in its useful operating range, in each vibration alternately prior to and after the passage of the mechanical resonator through its neutral position in said vibration, the extreme angular positions of the mechanical resonator in said useful operating range being, in absolute value, greater than said angular offset which is defined as the minimum angular distance between the zero angular position and the angular position of the centre of the coil.

16. The timepiece according to claim 15, wherein said angular offset is substantially equal to 180°.

17. The timepiece according to claim 15, wherein the electromagnetic braking pulses are generated by a short circuit of the coil during the distinct time intervals which are substantially equal to or greater than the maximum duration of time portions with no voltage induced in the coil around the two extreme positions of the mechanical resonator for the useful operating range of the mechanical oscillator.

18. The timepiece according to claim 15, wherein the timepiece includes a power supply circuit formed by a storage capacitor and a rectifier circuit for a voltage induced in the coil by at least one permanent magnet carried by the balance and coupled to the coil.

19. The timepiece according to claim 15, wherein the sensor is formed by the coil and at least one permanent magnet carried by the balance and coupled to the coil, said sensor further comprising a comparator receiving, at a first input, a signal representative of the voltage induced by said at least one permanent magnet and, at a second input, a reference voltage, the latter being selected such that the comparator supplies to a bidirectional counter of the measuring device a predetermined number of pulses per oscillation period of the mechanical oscillator for the useful operating range of said mechanical oscillator.

* * * * *